United States Patent [19]

Yamada et al.

[11] 4,173,955

[45] Nov. 13, 1979

[54] EXHAUST-GAS RECIRCULATION SYSTEM

[75] Inventors: Kinsaku Yamada; Chiaki Niida; Teruo Takayama, all of Katsuta, Japan

[73] Assignee: Hitachi, Ltd., Japan

[21] Appl. No.: 768,839

[22] Filed: Feb. 15, 1977

[30] Foreign Application Priority Data

Feb. 18, 1976 [JP] Japan ..... 51/15935

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| B 405,899 | 3/1976 | Moriya et al. | 123/119 A |
| 3,881,456 | 5/1975 | Nohira et al. | 123/119 A |
| 3,888,222 | 6/1975 | Tomita | 123/119 A |
| 3,896,777 | 7/1975 | Masaki et al. | 123/119 A |
| 4,041,914 | 8/1977 | Sugihara et al. | 123/119 A |

*Primary Examiner*—Charles J. Myhre
*Assistant Examiner*—Craig R. Feinberg
*Attorney, Agent, or Firm*—Craig and Antonelli

[57] ABSTRACT

An exhaust-gas recirculation (EGR) system for an internal-combustion engine comprises an EGR valve for controlling the amount of exhaust-gas recirculation installed midway in an EGR passage that establishes communication between the intake and exhaust pipes of the engine, and an exhaust-gas transducer valve for opening and closing by the exhaust pressure of the exhaust gas an atmospheric-releasing orifice formed midway in a vacuum conduit for introducing vacuum into the EGR valve. An acceleration control unit is connected to the exhaust-pressure transducer valve to prevent the entry of air from the atmospheric-releasing orifice into the vacuum conduit in the early stage of engine acceleration, even while the transducer valve is in operation, so as to control the generation of nitrous oxides during the acceleration.

5 Claims, 2 Drawing Figures

EXHAUST-GAS RECIRCULATION SYSTEM

BACKGROUND OF THE INVENTION

This invention relates to an exhaust-gas recirculation system for an internal-combustion engine, and more specifically to such a system improved so that the amount of exhaust-gas recirculation can be automatically increased during engine acceleration.

A variety of methods have been practiced to reduce the concentrations of oxides of nitrogen (hereinafter called "NOx" for simplicity) in the exhaust gases from internal-combustion engines. Of those attempts, the exhaust-gas recirculation ("EGR") by which the exhaust gas is partly returned to the combustion chamber has been known to be most effective in decreasing the NOx emissions.

A typical EGR system so far proposed includes a vacuum-operated EGR valve mounted midway in an EGR pipe providing communication between the intake and exhaust systems of the engine, in such a manner that the EGR valve is communicated with the portion of the intake system near the throttle valve therein through an exhaust-pressure transducer valve and via a vacuum passage. The term "exhaust-pressure transducer valve" as used herein means an arrangement by which a vacuum passage communicating the intake system of the engine with an EGR valve is opened midway to the atmosphere by an atmospheric-releasing orifice and the orifice, in turn, is opened or closed by a valve body fast on a diaphragm responsive to the exhaust pressure on the exhaust side of an EGR pipe in which the EGR valve is mounted, so that the negative pressure or vacuum being introduced into the EGR valve can be controlled.

The control of the vacuum introduction into the EGR valve by use of the exhaust pressure is resorted to because it permits the exhaust gas recirculation according to the rate of air flow into the engine. The exhaust pressure being approximately proportional to the rate of air intake, it follows that, if the exhaust pressure is used to control the entry of vacuum into the EGR valve, then the rate of exhaust gas recirculation can be increased as the air intake increases. With such an EGR system, however, it has been found that when the engine is accelerated by opening the throttle valve in the intake system the NOx emissions are large in the early stage of acceleration. This is attributable to the fact that in the early stage of acceleration with the throttle open the rate of exhaust gas recirculation is inadequate because it fails to catch up with the throttle opening accordingly, and hence the increased NOx emissions during the early period of acceleration.

SUMMARY OF THE INVENTION

The object of the invention is to provide an improved EGR system equipped with an exhaust-pressure transducer valve and which precludes any insufficiency of exhaust gas recirculation to the intake system during the engine acceleration.

To attain the end, the present invention is characterized by an acceleration control unit which during engine acceleration prevents the entry of air into the vacuum passage, through the atmospheric-releasing orifice formed therein, even while the exhaust-pressure transducer valve is in operation, thus avoiding a decrease of the vacuum being introduced into the EGR valve during acceleration.

DETAILED DESCRIPTION

Figure 1:
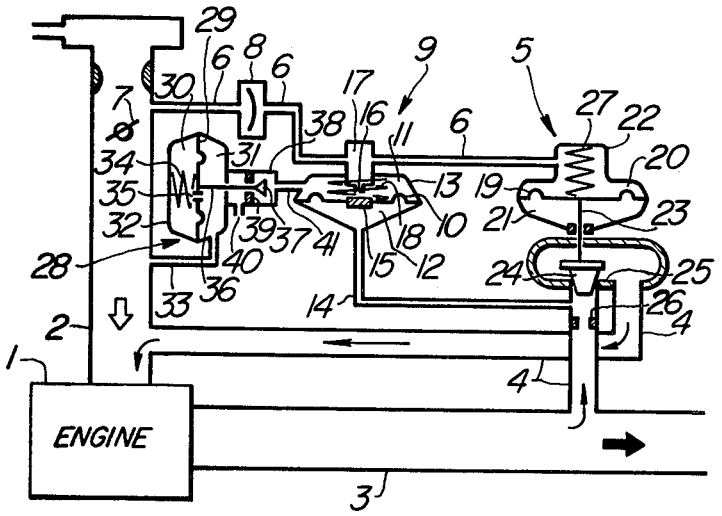
FIG. 1 is a schematic view of an EGR system embodying the invention.

Referring to the drawing, specifically to FIG. 1 illustrating an embodiment of the invention, the body of an internal-combustion engine, for example, a gasoline engine, is generally indicated at 1, with communication being established between its intake pipe 2 and exhaust pipe 3 by an exhaust-gas recirculation (EGR) pipe 4. On an intermediate point of the EGR pipe 4 is mounted an EGR valve 5 of a conventional design, to which one end of a vacuum conduit 6 is connected, the opposite end of the conduit 6 being open into the intake pipe 2, near a throttle valve 7 installed therein. The vacuum conduit 6 includes a water-temperature-responsive valve 8 to be opened or closed according to the temperature of cooling water in the engine 1, and an exhaust-pressure transducer valve 9 to be operated in response to the exhaust pressure. These valves 8, 9 control the negative pressure or vacuum that is admitted from the intake pipe 2 into the EGR valve 5 according to the temperature of cooling water in the engine 1 and to the exhaust pressure, in the manner to be described later.

The exhaust-pressure transducer valve 9 comprises a diaphragm 10 which provides two separate chambers 11, 12 in a casing 13. One chamber 12 is communicated with the EGR pipe 4 by a conduit 14, whereas the other chamber 11 is subject to the atmospheric pressure. To the center of the diaphragm 10 attaches a valve seat 15, which is movable axially with respect to an atmospheric-releasing orifice 16 in the chamber 11. Behind the orifice 16 is formed a vacuum chamber 17 integrally and in communication therewith. The atmospheric-releasing orifice 16 and the vacuum chamber 17 are supported by the casing 13 in such a manner that the opposing side of the valve seat 15 may move toward or away from the both. The chamber 11 subject to the atmospheric pressure is loaded with a diaphragm spring 18 which biases the diaphragm 10 downwardly as viewed in FIG. 1. This spring 18 keeps the valve seat 15 of the diaphragm 10 out of contact with the tip of the atmospheric-releasing orifice while the engine 1 is inoperative.

The EGR valve 5 has a diaphragm 19 providing two separate chambers 20, 21 in a casing 22, one of the chambers, 20, being connected to the vacuum conduit 6 so as to receive the vacuum from the intake pipe 2. A valve stem 23 secured at one end to the diaphragm 19 extends through the other chamber 21 into the EGR pipe 4, and a valve 24 carried by the other end of the valve stem 23 is held in contact with a valve seat 25 formed in the EGR pipe 4. A constriction 26 is also formed within the pipe 4, on the upstream side of the valve seat 25. In the chamber 20 to receive the intake vacuum, a spring 27 is fitted for biasing the diaphragm 19 downwardly as viewed in FIG. 1. The spring 27 urges the valve 24 into contact with the valve seat 25 in the EGR pipe 4.

Here it is to be noted by way of comparison that, with a conventional EGR system wherein the chamber 11 is directly subject to the atmospheric pressure, the water-temperature-responsive valve 8 opens as the engine coolant temperature exceeds a predetermined level, allowing the vacuum from the intake pipe 2 to flow into the vacuum conduit 6. If the exhaust pressure in the exhaust pipe 3 is low, the atmospheric-releasing orifice 16 of the exhaust-pressure transducer valve 9 and the valve seat 15 will remain apart and the vacuum introduced through the vacuum conduit 6 into the vacuum chamber 17 will be discharged into the atmosphere via the chamber 11 of the transducer valve 9 rather than being routed farther to the EGR valve 5. Consequently, the valve 24 will remain in the closed position and no exhaust gas recirculation will take place.

Next, if the throttle valve 7 is partly opened to a given degree, the exhaust pressure in the exhaust pipe 3 will increase accordingly to force the valve seat 15 in the exhaust-pressure transducer valve 9 upwardly as viewed in FIG. 1 until the seat 15 closes the atmospheric-releasing orifice 16. This makes the diversion of the vacuum from the conduit 6 to the atmosphere no longer possible, and therefore the vacuum will pull the diaphragm 19 of the EGR valve 5 upwardly to open the valve 24 and permit the recirculation of exhaust gas to the intake pipe 2.

The existing EGR system of the construction described has a disadvantage of poor initial response during acceleration of the engine 1. In the early stage of acceleration the amount of exhaust gas being re-introduced into the combustion cycle fails to be proportional to the throttle opening, and this leads to increased NOx emissions from the engine being accelerated.

The present invention aims at the provision of an improved EGR system which eliminates the above-described drawbacks of the prior art EGR systems and which precludes any shortage of the exhaust gas being returned into the intake pipe during engine acceleration. The EGR system improved in accordance with the invention will now be more fully described below.

The system of the invention is characterized in that, as compared with the chamber 11 of the conventional system that is directly open to the atmosphere, the same space in accordance with the invention is enclosed, or is not directly subject to the atmospheric action, in the casing 13 of the exhaust-pressure transducer valve 9 and that an acceleration control valve 28, adapted to operate in response to variations in the pressure within the intake pipe 2, is connected to the exhaust-pressure transducer valve 9.

The acceleration control valve 28 includes a diaphragm 29 providing two separate chambers 30, 31 within a casing 32, and one of the chambers 31, connects to a conduit 33 which, in turn, opens to a portion of the intake pipe 2 downstream of the throttle valve 7. The other chamber 30 accommodates a diaphragm spring 34 for biasing the diaphragm 29 rightwardly as viewed in FIG. 1. The chamber 30 is communicated with the chamber 31 through an orifice 35 in the diaphragm 29. To the diaphragm 29 is secured a horizontal valve stem 36, which extends airtightly through one end wall of the casing 32 and protrudes outwardly, carrying a valve 37 fixedly at its free end. A short, large-diameter cylinder 38 is attached to the same end wall of the casing 32 to surround the valve stem 36. In the mid portion of the cylinder is provided a valve seat 39 adapted to engage the valve 37. The valve seat 39 also serves as a partition and divides the space inside the cylinder 38 into two compartments. One of the chambers thus defined by the valve seat is open to the atmosphere via a conduit 40, and the other chamber accommodating the valve 37 is communicated with the upper closed chamber 11 of the exhaust-pressure transducer valve 9 through a conduit 41. The exhaust-pressure transducer valve 9 is of the same construction as the prior art ones, except that its chamber 11 loaded with the diaphragm spring 18 is not open to the atmosphere.

The operation of the essential parts of the EGR system in accordance with the invention will be described below.

When the pressure in the intake pipe 3 and the engine temperature are both above predetermined levels, the water-temperature-responsive valve 8 is open and the valve seat 15 in the exhaust-pressure transducer valve 9 is in the neighborhood of the atmospheric-releasing orifice 16 and, according to the distance between the orifice and the approaching valve seat, the vacuum from the upstream side of the throttle valve 7 is introduced through the vacuum conduit 6 into the chamber 20 of the EGR valve 5, thus pulling open the valve 24 upwardly as seen in FIG. 1. This permits the flow of exhaust gas from the exhaust pipe 3 back into the intake pipe 2 by way of the EGR pipe 4 as indicated by arrows.

Now if the throttle valve 7 is further opened to accelerate the engine from which the exhaust gas is being partly re-introduced into the intake pipe 2, the vacuum being conducted through the conduit 33 will be momentarily decreased. As a consequence, the diaphragm 29 will be moved from the neutral position to the left as viewed in FIG. 1, pulling the valve 37 connected thereto until it is seated on the valve seat 39. This shuts off the atmospheric pressure by closing its passage constituted by the conduits 40, 41, cylinder 38, and the chamber 11 of the exhaust-pressure transducer valve 9. There will be no entry of air through the atmospheric-releasing orifice 16 any longer. The vacuum in the vacuum conduit 6 will accordingly increase and the diaphragm 19 of the EGR valve 5 will be further pulled upwardly as viewed in FIG. 1. Therefore, the valve 24 will open further, allowing more exhaust gas to flow back to the intake pipe 2.

As long as the opening of the throttle valve 7 is kept constant for a predetermined time or longer, the two chambers 30 and 31 of the acceleration control valve are in communication through the orifice 35 and there is no pressure difference between the two. In this case, therefore, the valve 37 remains open and the exhaust-pressure transducer valve 9 responds merely to the exhaust gas pressure.

Figure 2:
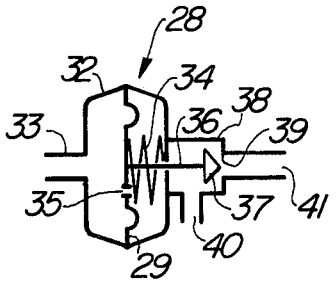
FIG. 2 is a detail of a modified form of the embodiment shown in FIG. 1.

The acceleration control valve 28 is not limited to the construction shown in FIG. 1 but may be of a modified form as in FIG. 2. Except for the design of the chamber for receiving the intake vacuum, the function of the latter control valve 28 is exactly the same as the former.

As described hereinbefore, the EGR system improved in accordance with the invention prevents the insufficiency of exhaust gas recirculation which would otherwise tend to occur in the early stage of engine acceleration, and thereby precludes increased NOx emissions during the acceleration.

What is claimed is:

1. An exhaust-gas recirculation system for an internal-combustion engine comprising an exhaust-gas recirculation passage which provides communication between the intake and exhaust pipes of the engine; an exhaust-gas recirculation valve having a valve inserted in said exhaust-gas recirculation passage to control the amount of exhaust gas flowing in said passage, a diaphragm connected with said valve, and a casing forming a chamber between the casing and said diaphragm; a vacuum conduit for introducing from said intake pipe the vacuum therein into said chamber, an atmospheric release orifice formed in said vacuum conduit, an exhaust-pressure transducer valve for controlling the amount of air introduced into said vacuum conduit through said atmospheric-release orifice in response to the pressure variation of said exhaust pipe; and an acceleration control unit for preventing the entry of air through said atmospheric-release orifice into said vacuum conduit in response to the pressure change in said intake pipe caused by acceleration of the engine, wherein said exhaust pressure transducer valve comprises a transducer valve casing, a second diaphragm dividing the inside space of said transducer valve casing into first and second chambers, a conduit for introducing the exhaust pressure in said exhaust gas pipe into said first chamber of said transducer valve, a passage for communicating said second chamber of said transducer valve with the atmosphere, a valve member fixed to the second chamber side of said second diaphragm for opening and closing said atmospheric-release orifice projecting into said second chamber of said transducer valve; and wherein said acceleration control unit comprises a control unit casing, a third diaphragm dividing the inside of the control unit casing into third and fourth chambers, said third chamber being subject to vacuum pressure from said intake pipe, said fourth chamber constituting an enclosed space, and a valve member fixed to said third diaphragm and arranged to open and close said passage for communicating said second chamber of said transducer valve casing with the atmosphere.

2. A system according to claim 1, wherein said conduit for introducing the exhaust pressure into said first chamber of said exhaust pressure transducer valve opens into said exhaust gas recirculation passage at a zone between said exhaust-gas recirculation valve inserted therein and a constriction formed in said exhaust-gas recirculation passage upstream of said valve.

3. A system according to claim 1, wherein the third diaphragm forming part of said acceleration control unit is provided with an orifice establishing communication between said third and fourth chambers and a spring means for biasing said diaphragm toward the third chamber.

4. A system according to claim 1, wherein said third chamber of said acceleration control unit is supplied with the pressure from the portion of said intake pipe on the downstream side of the throttle valve installed therein.

5. The system according to claim 1, which further comprises a temperature-responsive changeover valve installed in said vacuum conduit and actuated in response to the engine temperature so as to cut off the communication from the intake pipe when the engine temperature is lower than a predetermined value.

* * * * *